US005418833A

United States Patent [19]

Logan

[11] Patent Number: 5,418,833

[45] Date of Patent: May 23, 1995

[54] HIGH PERFORMANCE X-RAY ANTI-SCATTER GRID

[75] Inventor: Clinton M. Logan, Pleasanton, Calif.

[73] Assignee: The Regents of the University of California, Oakland, Calif.

[21] Appl. No.: 281,550

[22] Filed: Jul. 28, 1994

Related U.S. Application Data

[63] Continuation of Ser. No. 51,228, Apr. 23, 1993, abandoned.

[51] Int. Cl.[6] ..... G21K 1/00

[52] U.S. Cl. ..... 378/154; 378/155

[58] Field of Search ..... 378/154, 155

[56] References Cited

U.S. PATENT DOCUMENTS 2,605,427 7/1952 Delhumeau ..... 378/154

5,231,654 7/1993 Kwasnick et al. ..... 378/154

OTHER PUBLICATIONS

UCRL-5000-92-10.11.12, Energy and Technology Review, "Digital Mammography", CM Logan, Oct.-Nov.-Dec. 1992, pp. 27-36.

*Primary Examiner*—Craig E. Church

*Attorney, Agent, or Firm*—Henry P. Sartorio; L. E. Carnahan

[57] ABSTRACT

An x-ray anti-scatter grid for x-ray imaging, particularly for screening mammography, and method for fabricating same, x-rays incident along a direct path pass through a grid composed of a plurality of parallel or crossed openings, microchannels, grooves, or slots etched in a substrate, such as silicon, having the walls of the microchannels or slots coated with a high opacity material, such as gold, while x-rays incident at angels with respect to the slots of the grid, arising from scatter, are blocked. The thickness of the substrate is dependent on the specific application of the grid, whereby a substrate of the grid for mammography would be thinner than one for chest radiology. Instead of coating the walls of the slots, such could be filed with an appropriate liquid, such as mercury.

20 Claims, 2 Drawing Sheets

HIGH PERFORMANCE X-RAY ANTI-SCATTER GRID

The United States Government has rights in this invention pursuant to Contract No. W-7405-ENG-48 between the United States Department of Energy and the University of California for the operation of Lawrence Livermore National Laboratory.

This is a continuation of application Ser. No. 08/501,228 filed Apr. 23, 1993, now abandoned.

BACKGROUND OF THE INVENTION

The present invention relates to x-ray imaging, particularly to a grid for reducing the deleterious effects of the scatter of x-rays during imaging, and more particularly to an improved x-ray anti-scatter grid and fabrication method involving a plurality of parallel or crossed slots formed in a substrate having low x-ray opacity and coated or filled with a material having high x-ray opacity, whereby the scattered x-rays are blocked from entering the grid.

Today's mammography machines usually use an x-ray tube with a molybdenum anode. The breast is compressed between two plates to a thickness of about 5 cm on average. Exposure times are tenths of seconds, and two views at different angles through each breast are usually taken to yield four film images per exam.

The film is not exposed directly by x-rays; rather, it is exposed by visible light produced by x-ray-induced scintillation in a screen. The screen/film system offers high detection efficiency for x-rays but lower spatial resolution than film used without a screen.

When forming an x-ray image of an object, scatter of x-rays within the object causes degradation of the image. Scatter is a particularly severe problem in medical x-ray imaging, particularly in mammography due to the degrading of the image thereby increasing the difficulty of reading the mammogram by the conventional techniques.

To reduce scattered photons (x-rays) from reaching the image plane and thus to keep the contrast high, an anti-scatter device is generally used. This device, called a Bucky grid, is placed between the breast and the film/screen. These grids are designed to be relatively transparent to x-rays arriving from the direction of the source, but have lower transmission for x-rays entering from other angles. Since scattered x-rays come from all directions, the purpose of the grid is to selectively attenuate scatter. The conventional grid consists of venetian-blind-like slats that pass most unscattered photons but block those coming from off-angles. The performance of the conventional grid is poor because the grid blocks some unscattered x-rays and nearly all of the scattered ones. This results in necessitating increase of the radiation dose to a patient by a factor of about three to produce a properly exposed film.

The grids are usually put into motion during the imaging process so as to blur the shadow of the grid itself. Problems with present designs include complex fabrication methods, poor product yield, high expense, and poor performance. The high mass of the grids requires high forces to induce rapid motion. This results in vibration of the surrounding equipment and introduces motion blur in the image. Thus, there exists a need for an x-ray anti-scatter grid that will improve the performance of x-ray imaging, particularly traditional screening mammography.

The present invention is directed to an improved x-ray anti-scatter grid, and fabrication method therefor, which overcomes the above-referenced problems with the conventionally utilized Bucky grids. The grid of this invention utilizes parallel or crossed slots of microchannels in a substrate, such as silicon, which are coated with a material having a high x-ray opacity such as gold, or filled with an appropriate liquid, such as mercury. Also, this grid eliminates the need to put it in motion during the exposure, as is required from the conventionally used grids.

SUMMARY OF THE INVENTION

It is an object of the present invention to provide an improved x-ray anti-scatter grid.

A further object of the invention is to provide a method of fabricating x-ray anti-scatter grids, particularly adapted for mammographic applications.

Another object of the invention is to provide a microgrid for improved mammography which utilized a plurality of microchannels formed in a substrate and coated with a material of high x-ray opacity.

Another object of the invention is to provide a method for fabricating x-ray anti-scatter grids, by etching microchannels on one or both sides of a substrate, and then coating the walls of the microchannels with a high x-ray opacity material.

Another object of the invention is to provide a grid having features so small that it is not necessary to put the grid in motion during the exposure, thereby providing a means by which the entire machine may be simpler in construction.

Other objects and advantages of the present invention will become apparent from the following description and accompanying drawings. Basically the high performance x-ray anti-scatter grid of this invention is produced by forming, as by etching, a plurality of parallel or crossed slots or microchannels in a substrate, such as silicon, and then coating walls of the slots or microchannels with a high x-ray opacity material, such as gold, or filling the slots or microchannels with a high x-ray opacity liquid, such as mercury. Thus, x-rays incident along paths which strike the coated walls are blocked while those striking other sections of the substrate pass through. Since scattered x-rays are generally incident at angles from the directed path from a source, the high x-ray opacity material (coating or liquid) prevents passage thereof through the grid substrate, thereby preventing degradation of the image due to the scatter of x-rays. The thickness of the substrate may be changed for different applications, with a grid for chest radiology, for example.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 1:
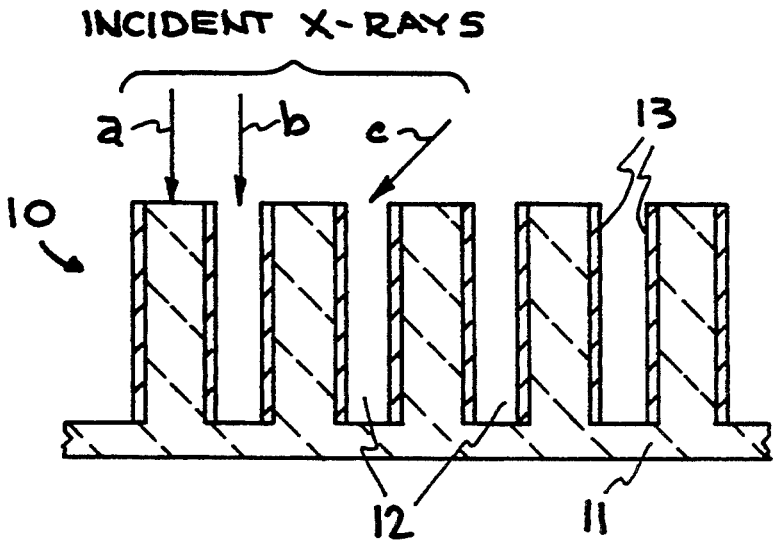
FIG. 1 illustrates an embodiment of the invention utilizing coated microchannels formed in a substrate in accordance with the invention.

The present invention involves an improved x-ray anti-scatter grid and method of fabrication, which reduces or eliminates the problem of image degradation due to the scatter of x-rays within the object being imaged. The function of the grid is to pass image photons but to block the scattered photons. The photons (x-rays) from an x-ray source which pass substantially directly through an object being imaged pass through the grid onto an image recorder, and photons (x-rays) from the x-ray source which are scattered (direction changed) within the object being imaged are blocked from passing through the grid onto the image recorder. Thus, the scatter of x-rays within the object being imaged does not cause degradation of the image. Such anti-scatter grids are particularly important in current medical x-ray imaging techniques, especially in mammography, as described hereinafter. Also, the grid features are of such small size that it is not necessary to put the grid in motion during exposure, since the film/-screen is not capable of resolving objects of only a few $\mu$m in dimension, which not only allows the entire machine to be made simpler, but eliminates the problem of shaking causing blurring of the breast features.

As it is presently practiced, mammography does not detect all breast cancers. Many mineral deposits are faint and subtle on conventional x-ray film, and rather than having distinct edges, they fade gradually into the surroundings. Thus, they can be quite difficult to locate. The potential for oversight is large even when screening is done by the most experienced radiologists. Degradation of the images due to the scatter of x-rays with the object being imaged increases the potential for oversight.

When directly viewing traditional x-ray film on a lightbox, a mammographer must systematically search the entire image—by literally using a magnifying glass—to detect all potentially important microcalcifications. Obviously, this type of screening work requires a highly trained (and highly paid) individual. Medical center radiologists estimate that as many as 80% of all women have some calcifications in their breasts. Even though most breasts exhibit some degree of calcification, the presence of deposits alone does not necessarily mean cancer. The size, shape, and distribution of clustered deposits determine whether they represent an indicator for breast cancer in an individual.

In addition, the breast contains many other complex structures that exhibit radiographic contrast, and scratches or spots on the x-ray film can mimic the appearance of microcalcifications. All these factors contribute to the problem of differentiating trouble spots from false alarms. For example, normal breast connective tissue forms linear features in an x-ray image. When two or more such features cross in the image, they may appear as a white spot on film.

Compounding the difficulty of visually spotting significant microcalcifications is the speed at which expert mammographers reach a decision regarding malignancy. At one prominent mammography clinic, 30,000 cases are screened each year, and some radiologists scan up to 300 film records in a single day. The American Cancer Society recommends that a woman between the ages of 40 and 49 have a mammogram every two years and that she do so annually thereafter. If every female in the United States followed this recommendation, 170 million new images would need to be screened each year.

Microcalcifications are often present for reasons other than cancer. However, if the pattern of calcification in an individual is suspicious, then biopsy may be warranted. A biopsy usually means surgical removal of the tissue and subsequent examination under a microscope. Of those women under going biopsy as a result of a suspicious mammogram, about one in five have breast cancer.

Using traditional x-ray film screening techniques, which do not apply quantitative criteria, varying interpretations are inevitable, and the miss rate today is fairly high. Indeed, one recent analysis of 320 cases of breast cancer in a screened population revealed 77 cancers (24%) that were missed by screening mammography. In this recent analysis, "missed" is taken to mean that retrospectively, an earlier mammogram revealed a structure or cluster of microcalcifications that are of medical significance. It is common for a breast cancer to be discovered by manual examination even though a mammogram within the preceding year or two has been judged to be negative. In the abovereferenced analysis, 19 of the 77 missed cancers (25%) were found by means other than mammography. As it is presently practiced, interpreting mammograms is an exceedingly difficult art. The degradation of the images due to x-ray scatter adds to this difficulty.

The image-capture and viewing technique in conventional mammography (looking at film) does not allow any adjustment of contrast, and the image is not computationally analyzed. Optimal quality depends on producing high-contrast images and it requires devices such as compression plates and scatter grids to minimize the degrading effect of scattered x-rays. Because film serves as both the detector and the display in conventional mammography, it limits the quality that can be achieved. In fact, both image quality and patient dose are compromised to achieve maximum contrast. Thus, prevention of the scattered x-rays (x-ray directions changed as they pass through he object being imaged) from passing through the grid onto the image recorder, will greatly enhance screening mammography.

The present invention utilizes, for example, anisotropic etching methods to produce deep, narrow slots, openings, grooves, or microchannels in a grid substrate, such as a silicon (Si) wafer. However, if the substrate is composed of beryllium (Be), for example, ion beam milling could be used to form the slots or microchannels. An opening as referred to hereinafter may extend through or partially through the substrate. The microchannels (see FIG. 1) can be parallel or crossed (FIG. 4), and the openings, grooves, or slots (see FIG. 2) can be etched on one or both sides of the substrate (Si wafer). The thickness of the wafer or substrate is chosen so that acceptable transmission occurs for the particular application. Thus, a grid for mammography would be made from a thinner substrate (Si wafer) than a grid for chest radiology. The wall surfaces of the microchannels or slots are coated with a material with high x-ray opacity (material with high density and atomic number), such as gold (Au). If desired the grooves or slots of the FIG. 2 embodiment can be filled with the high x-ray opacity or x-ray attenuating material. The attenuating material can be applied by many known processes such as physical vapor deposition, chemical vapor deposition, electroless plating, electroplating, evaporation, painting, powder coating, casting, sputtering, etc. Also in the case of filled grooves or slots, the filling can be a liquid, such as mercury (Hg). The high x-ray opacity material may have a density in the range of 10 to 23 g/cm$^3$, and an atomic number in the range of 72 to 83, plus uranium (atomic number 92).

FIG. 1 illustrates an embodiment of the anti-scatter grid made in accordance with the present invention. The grid, generally indicated at 10, is composed of a substrate 11 made of silicon (Si) having a plurality of parallel microchannels or slots 12 having the walls or side surfaces thereof coated with a layer or film 13 of gold (Au). The substrate 11 may have a thickness of 100 μm to 5.0 mm, width of 18 cm to 40 cm, and length of 24 cm to 50 cm, depending on the application of the grid 10. For mammography, a preferred embodiment has a thickness of 180 μm width of 18 cm, and length of 24 cm. The microchannels 12 may have a length of 1–14 cm, depth of 100 to 160 μm, and cross-section or width of 5 to 10 μm, with the preferred being depth of 150 μm and width of 12 μm. The high x-ray opacity layer or film 13 may have a thickness of 0.5 to 5.0 μm, with the preferred thickness of 1.0 μm for mammography. The substrate 11 may, in addition to silicon, be made of any x-ray transparent material, such as beryllium (Be), carbon (C), aluminum (A1, and polymers; with the layer or film 13, being formed, in addition to gold, from other high density/high atomic number material, such as tungsten (W), rhenium (Re), and platinum (Pt). As pointed out above, the layer or film 13 may be deposited by various known techniques, but preferably by evaporation. Examples of the polymers used as the substrate 11 include Mylar and Kapton, made by DuPont, and Saran, made by Dow Chemical.

Currently silicon (Si) is commercially available up to 8 inch diameter wafers, which is not large enough to make an 18×24 cm grid for mammography. Thus, these grids are put together in a mosaic, such as four rectangular pieces. The largest standard format for today's grids is 14×17 inch for chests. The length of the slots and/or channels should be as long as the substrate physically allows.

In operation of the anti-scatter grid of FIG. 1, with the grid being located between the object to be imaged and an image recorder, x-rays incident along paths A and B pass easily through the silicon substrate 11, whereas x-rays incident at angles arising from scatter within the object being imaged, as exemplified by path C, are blocked by the gold coating or layer 13 on the wall surfaces of the microchannels 12.

Figure 2:
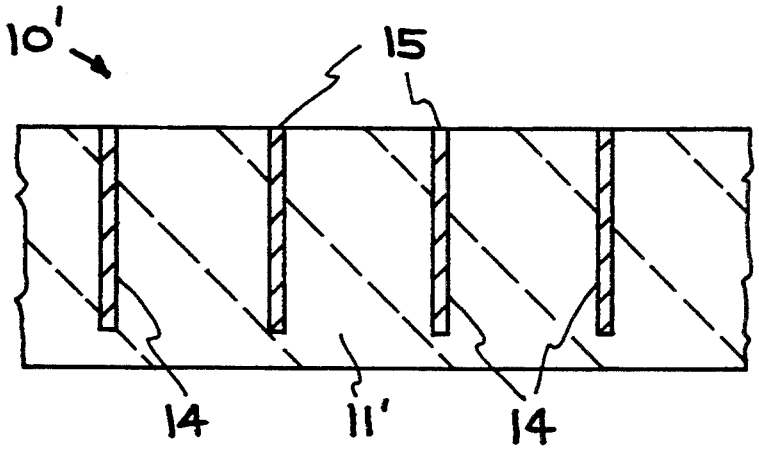
FIG. 2 illustrates an embodiment of the invention utilizing slots formed on the surface of a substrate which are coated or filled with a high x-ray opacity material.

In the FIG. 2 embodiment, the anti-scatter grid 10' is composed of a silicon substrate 11' having a plurality of openings, grooves, or slots 14 etched or otherwise formed on one or both sides of the substrate 11'. The grooves or slots 14 provided with a layer or coating 14, or filled with gold or other high x-ray opacity material. As in the FIG. 1 embodiment, the gold coated grooves or slots 14 function to block the x-ray incident at angles from scatter. The grooves or slots 14 may be formed by etching to a depth of 15 μm to 1.5 mm, and width of 1 to 100 μm, and length of 1 to 30 cm, with a preferred depth of 100 μm, width of 2.5 μm, and length of 18 cm for mammography. The gold coating or layers 15 may have a thickness of 0.5 to 1.0 μm, preferably 1.0 μm, or may fill the grooves or slots. The grooves or slots 14 may be filled with a high x-ray opacity liquid, such as mercury by (Hg). As in the FIG. 1 embodiment, other exemplified materials may be used as the substrate 11' and coating 15.

By way of example, the anti-scatter grid may be fabricated by the following sequences procedure:

Use a commercially available wafer of single crystal Si with the 110 crystal plane as the surface planes. These wafers are available in any desired thickness and with both sides polished (for etching from both sides). The crystalline orientation of the Si then allows deep features to be etched with side walls that are at 35.3 degrees to the 110 plane.

Form an etch mask of $Si_3N_4$. This can be done with standard methods. The layer should be about 1000Å thick.

Produce the etch pattern by photolithography. This is best done by using a positive photo resist. This is typically a UV sensitive polymer. When the desired pattern is projected onto the resist and developed, the areas of the resist that have been exposed to UV are dissolved away. (A negative resist is made resistant to dissolution by the UV, so works in the opposite sense.)

Transfer the pattern to the $Si_3N_4$ by plasma etching. Use an atmosphere of $CF_4$ with 3 percent $0_2$ added and a pressure of 500 mTorr. About 100 watt of RF power is required. Transfer time is about 5 min. This plasma etching removes the $Si_3N_4$ in the regions not protected by the resist. The resist is then removed by dissolution with acetone.

Etch the Si with KOH. This material will deepen the channels at a rate about 600 times faster than it widens. This allows precise control of the final geometry. The rate of etching is strongly temperature dependent, proceeding at about 5 μm/hour at 35° C. and about 100 times faster at 70° C.

A final etch in HF removes the $Si_3N_4$ without attacking the Si.

One method for applying the Au coating is by evaporation. The common commercial device for this purpose uses an electron beam to heat the Au to a temperature where Au vapor evaporates from the surface. The Si substrate is held at slight angle to the direction of vapor flow so that the vapor coats the side walls of the Si structure. Any Au that coats where not desired can be removed.

There are two very simple ways to fill slots with high opacity material. Casting and something call packing. Casting would involve pouring a molten metal, i.e. Pb, into the slots and cooling to solidify. For packing, the class of materials used for Ag amalgam dental fillings would be especially useful. One takes powder of a Ag alloy and mixes it with Hg to make a slurry that is then packed into the slot (as in filling a tooth). The Hg undergoes a solid state reaction to form a solid alloy with the powder. Packing could also involve a powder of high opacity metal and a binder such as epoxy or a UV curing resin. The mercury in the FIG. 2 embodiment can either be retained in the slots by surface tension forces, or a cover of low x-ray opacity can be applied. Polymer films, such as KAPTON, made by Dupont, and MYLAR, made by Dupont, are especially useful as covers for the mercury.

Figure 3:
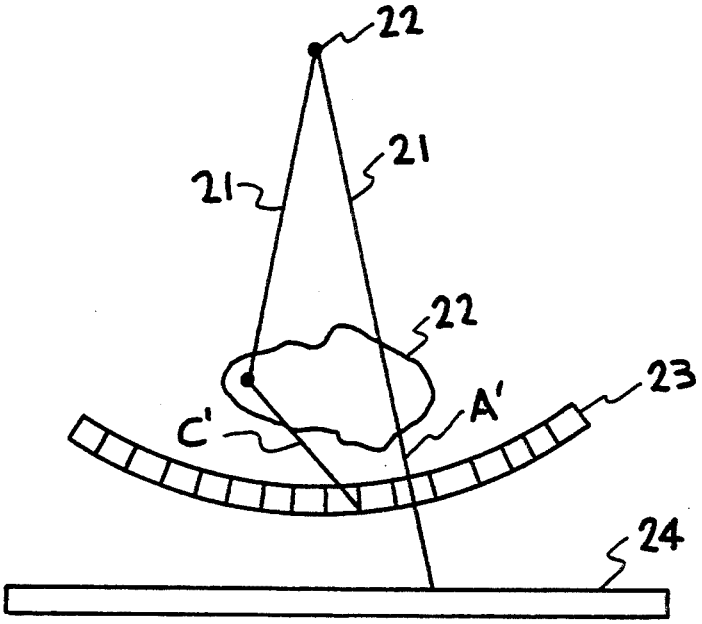
FIG. 3 illustrates an embodiment of the invention using a curved grid to provide desired "focus" of the grid.

FIG. 3 illustrate an embodiment wherein there is a need to "focus" the grid (make the grid align to a specific point where the x-ray source is to be located). This is accomplished by curving the grid after the slots or grooves are made and coated or filled, as described above. In FIG. 3, x-rays 20 from an x-ray source 21 are directed onto an object 22 to be imaged, with a curved anti-scatter grid 23 being located intermediate the object 22 and an image recorder 24. Certain of the x-rays from source 21 pass along path A' align passing through the object 22 and then pass through the grid 23 onto image recorder 24, while other x-rays from source 21 scatter with object 22 and pass along path C' at an angle to the grid 23 and strike the above-described coated surfaces of the grid thereby blocking passage there though, whereby these scatter x-rays do not degrade the image on the image recorder.

Figure 4:
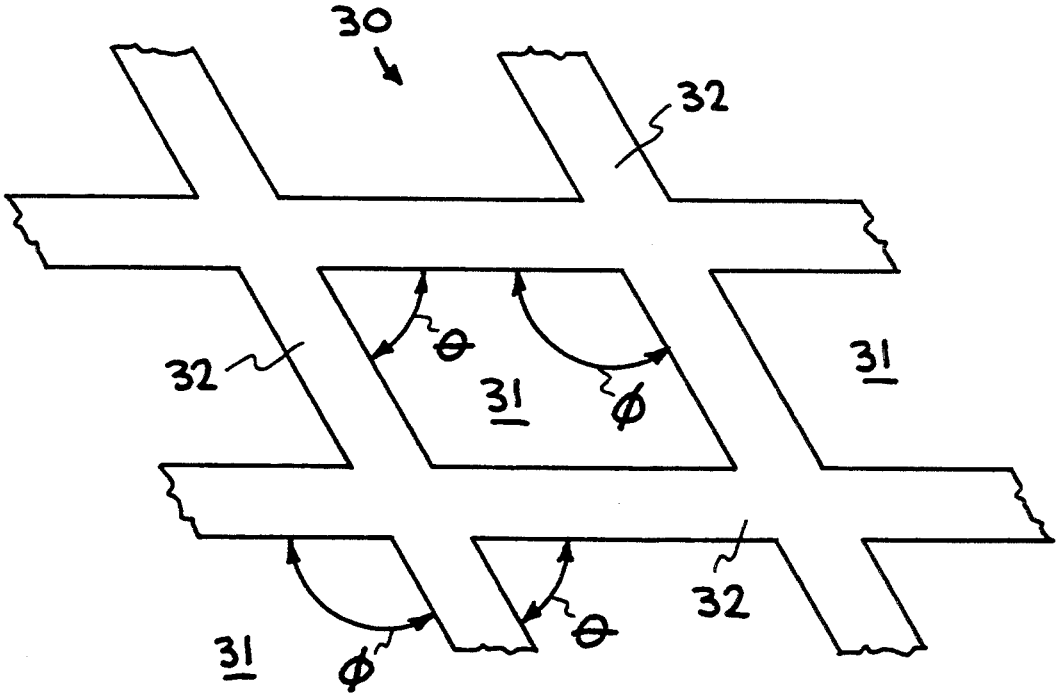
FIG. 4 illustrates a section of another embodiment of the invention using a "crossed" grid configuration.

FIG. 4 illustrates a section of a "crossed" slot "webbed" grid configuration wherein a wafer or substrates 30, such as silicon, is etched to provide a plurality of openings 31, shown as parallelograms in this embodiment, thereby forming silicon webs or strips 32 between the openings 31. The openings 31 may be formed on one or both sides of the substrate 30, or can extend through the substrate. The openings 31, extending through the substrate 30, have the edges thereof coated with a high x-ray opacity material, such as gold or tungsten, as described above with respect to the FIG. 1 embodiment, or if formed one or both sides of the substrate, the openings 31 would be either coated or filled with a high x-ray opacity material, as described above with respect to the FIG. 2 embodiment.

Depending on the thickness of the substrate and other factors, it may be desireable to form opening 31 by etching from both sides to form an opening which extends through the substrate. As shown in FIG. 4, the wafer 30 is etched to leave a crossed grid of very fine silicon webs. In this embodiment the substrate or wafer 30 having a thickness of 100 $\mu$m has parallelogram configured openings 31 have angles $\phi$ of 70.6 and $\theta$ of 109.4 with all sides being 17 $\mu$m, and with the webs 32 having a width of 3 $\mu$m. Where the thickness of the substrate with the openings extending therethrough results in a fragile grid, a thin region of solid silicon can be left near the mid-plane, and the openings of the substrate coated or filled as in FIG. 2 embodiment.

The embodiment of FIG. 4, with the openings extending through the substrate, provides a grid with about 60% open area and presents minimal attenuation of the desired x-rays from the source. This embodiment can be curved with a spherical radius of curvature to achieve 2-D focusing, while the parallel slot configured grid (FIGS. 1 and 2) would only have to be curved into a cylinder.

It has thus been shown that the present invention provides improved anti-scatter grids for x-ray imaging applications, and particularly for screening mammography, and to processes for fabricating the grids. The grids of this invention are fabricated by low cost and simple techniques, and produce high performance, thus advancing the state of this art.

While particular embodiments, materials, parameters, etc. have been illustrated and/or described to set forth the principles of this invention, such are not intended to be limiting. Modifications and changes will become apparent, and it is intended that the invention be limited only by the scope of the appended claims.

I claim:

1. In an x-ray imaging apparatus, the improvement comprising:

an x-ray anti-scatter grid, said grid including a substrate constructed of material substantially transparent to x-rays, said substrate being provided with a plurality of openings therein which extend only partially therethrough, said openings having a coating only on wall surfaces thereof of a high x-ray opacity material.

2. The improvement of claim 1, wherein said openings in said substrate define a plurality of parallel microchannels.

3. The improvement of claim 1, wherein the substrate is constructed of silicon, and wherein the coating is composed of gold.

4. The improvement of claim 3, wherein said openings in said substrate define a plurality of parallel microchannels.

5. The improvement of claim 1, wherein said coating of high x-ray opacity material has a density in the range of 10 to 23 g/cm$^3$, and an atomic number of 72 to 83, and 92.

6. The improvement of claim 1, wherein said openings have a parallelogram configuration.

7. The improvement of claim 6, wherein said said openings in said substrate is silicon, and substrate are coated with material having a density of about 10 to 23 g/cm$^3$, and an atomic number of 72 to 83 and 92.

8. The improvement of claim 7, wherein the coating is gold.

9. The improvement of claim 1, wherein said substrate is constructed from material selected from the group consisting of silicon, beryllium, carbon, aluminum, and selected polymers.

10. An anti-scatter grid for x-rays, comprising:

a substrate of material which is substantially transparent to x-rays, said substrate including a plurality of openings therein which extend only partially therethrough, and said openings having a layer of high x-ray opacity material only on the wall surfaces thereof.

11. The anti-scatter grid of claim 10, wherein said openings have parallelogram configurations.

12. The anti-scatter grid of claim 10, wherein said substrate is selected from material of the group consisting of silicon, beryllium, carbon, aluminum, and selected polymers; and wherein said layer of material is selected from the group of gold, rhenium, platinum, tungsten, and uranium.

13. The anti-scatter grid of claim 10, wherein said openings are constructed to define a plurality of parallel microchannels.

14. The anti-scatter grid of claim 13, wherein said substrate is constructed from material selected from the group consisting of silicon beryllium, carbon, aluminum, and selected polymers.

15. The anti-scatter grid of claim 14, wherein said layer of material on said wall surfaces of said microchannels is formed from material selected from the group consisting of gold, tungsten, rhenium, and platinum.

16. A method for fabricating an x-ray anti-scatter grid, comprising the steps of:

forming a plurality of openings in a substrate of x-ray transparent material which extend only partially through said substrate, and coating only the wall surfaces of the openings with a high x-ray opacity material.

17. The method of claim 16, additionally including the step of forming the substrate from silicon, and the step of forming the coating from gold.

18. The method of claim 16, wherein the step of forming the plurality of openings in the substrate is carried out using a techniques selected from etching and ion beam milling of the substrate to form a plurality of parallel microchannels therein.

19. The method of claim 16, wherein the step of forming the plurality of openings in the substrate is carried out by a technique selected from the group of etching and ion beam milling of the substrate to form a plurality of parallelograms in at least one side of the substrate.

20. The method of claim 16, wherein the step of coating the wall surfaces of the openings is carried out by evaporation techniques.

* * * * *